US006505428B1

(12) United States Patent
Williams-King et al.

(10) Patent No.: US 6,505,428 B1
(45) Date of Patent: Jan. 14, 2003

(54) AQUARIUM PHOTO DISPLAY DEVICE AND METHOD

(76) Inventors: Nina L. Williams-King, 6995 NW. 186th St., Miami, FL (US) 33015; Julius King, III, 6995 NW. 186th St., Miami, FL (US) 33015

( * ) Notice: Subject to any disclaimer, the term of this patent is extended or adjusted under 35 U.S.C. 154(b) by 0 days.

(21) Appl. No.: 09/516,404

(22) Filed: Mar. 1, 2000

(51) Int. Cl.[7] ..... G09F 3/04
(52) U.S. Cl. ..... 40/661; 119/253; 119/256
(58) Field of Search ..... 40/661; 428/542.6; 119/256, 257, 258, 253, 246

(56) References Cited

U.S. PATENT DOCUMENTS

| | | | | | |
|---|---|---|---|---|---|
| 1,991,683 | A | * | 2/1935 | Kelly | 119/253 |
| 3,119,371 | A | * | 1/1964 | Zuckerman | 119/258 |
| 3,618,238 | A | * | 11/1971 | Willinger | 40/661 |
| 4,136,638 | A | * | 1/1979 | Fedor | 119/257 |
| 4,225,369 | A | * | 9/1980 | Felchlin | 40/611 |
| 4,771,557 | A | * | 9/1988 | Bowman | 40/661 |
| 4,947,792 | A | | 8/1990 | Kaminski | 119/5 |
| 4,967,694 | A | * | 11/1990 | Waldman | 119/246 |
| 4,974,545 | A | | 12/1990 | Jones | 119/5 |
| 5,090,357 | A | | 2/1992 | Punce | 119/5 |
| 5,090,358 | A | * | 2/1992 | Waldman | 119/257 |
| 5,307,579 | A | * | 5/1994 | Clayton et al. | 40/611 |
| 5,749,320 | A | * | 5/1998 | Sydenstricker | 119/253 |
| 5,826,851 | A | * | 10/1998 | Arbisi | 40/594 |
| 5,898,962 | A | * | 5/1999 | McNeal | 40/661 |
| 6,038,803 | A | * | 3/2000 | Wilkins | 40/594 |

* cited by examiner

*Primary Examiner*—Anthony Knight
*Assistant Examiner*—Doug Hutton
(74) *Attorney, Agent, or Firm*—Joseph N. Breaux

(57) ABSTRACT

An aquarium photo display device and method for displaying one or more photographs in connection with an aquarium. The aquarium photo display device includes a static cling attachable sea-life decorated plastic background sheet having a transparent photo receiving pocket within which a photo is removably insertable. The photo display method includes the steps of a) providing an aquarium photo display device; b) inserting a photo into the transparent photo receiving pocket of the aquarium photo display device; and c) placing the static cling attachable sea-life decorated plastic background sheet against the back glass of the aquarium with the photo facing into the aquarium.

1 Claim, 1 Drawing Sheet

AQUARIUM PHOTO DISPLAY DEVICE AND METHOD

TECHNICAL FIELD

The present invention relates to photo display devices and methods and more particularly to an aquarium photo display device and method wherein the aquarium photo display device includes a static cling attachable sea-life decorated plastic background sheet having a transparent photo receiving pocket within which a photo is removably insertable and wherein the photo display method includes the steps of a) providing an aquarium photo display device includes a static cling attachable sea-life decorated plastic background sheet having a transparent photo receiving pocket within which a photo is removably insertable; b) inserting a photo into the transparent photo receiving pocket; and c) placing the static cling attachable sea-life decorated plastic background sheet against the back glass of an aquarium with the photo facing into the aquarium.

BACKGROUND ART

Many individuals enjoy watching fish in an aquarium. In addition, many individuals enjoy looking at photos of family and friends. It would be a benefit to those individuals who enjoys both of these to have a photo display system that was attachable to the back glass of an aquarium such that one or more photos were viewable by looking into the aquarium.

GENERAL SUMMARY DISCUSSION OF INVENTION

It is thus an object of the invention to provide an aquarium photo display device that includes a static cling attachable sea-life decorated plastic background sheet having a transparent photo receiving pocket within which a photo is removably insertable.

It is a further object of the invention to provide an aquarium photo display method that includes the steps of a) providing an aquarium photo display device includes a static cling attachable sea-life decorated plastic background sheet having a transparent photo receiving pocket within which a photo is removably insertable; b) inserting a photo into the transparent photo receiving pocket; and c) placing the static cling attachable sea-life decorated plastic background sheet against the back glass of an aquarium with the photo facing into the aquarium.

Accordingly, an aquarium photo display device and method are provided. The aquarium photo display device includes a static cling attachable sea-life decorated plastic background sheet having a transparent photo receiving pocket within which a photo is removably insertable. The aquarium photo display method includes the steps of a) providing an aquarium photo display device includes a static cling attachable sea-life decorated plastic background sheet having a transparent photo receiving pocket within which a photo is removably insertable; b) inserting a photo into the transparent photo receiving pocket; and c) placing the static cling attachable sea-life decorated plastic background sheet against the back glass of an aquarium with the photo facing into the aquarium.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
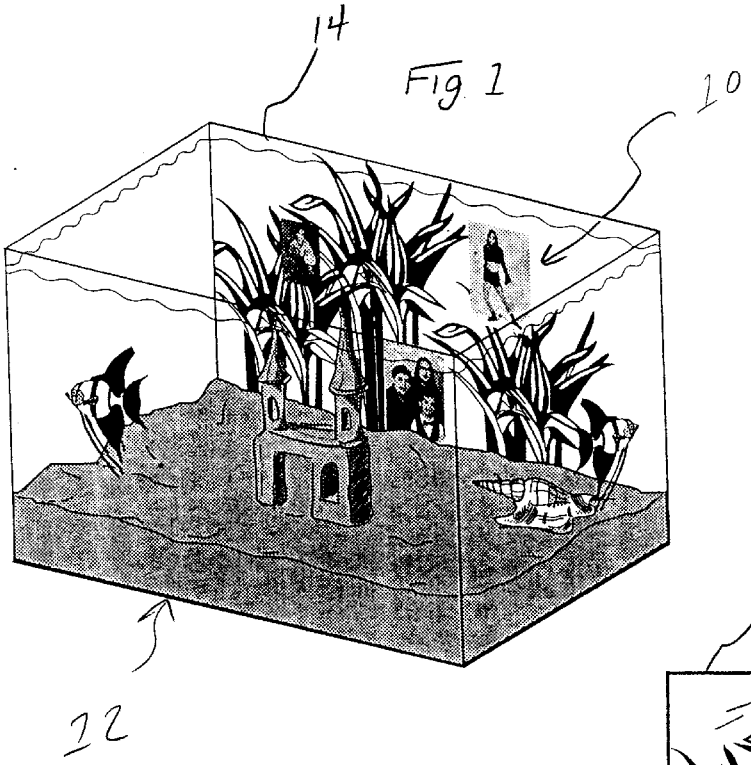
FIG. 1 is a perspective view of a representative aquarium tank with an exemplary embodiment of the aquarium photo display device secured to a back wall of the aquarium tank with photographs removably inserted into the three photo retaining pockets provided on the static cling attachable sea-life decorated plastic background sheet.
Figure 2:
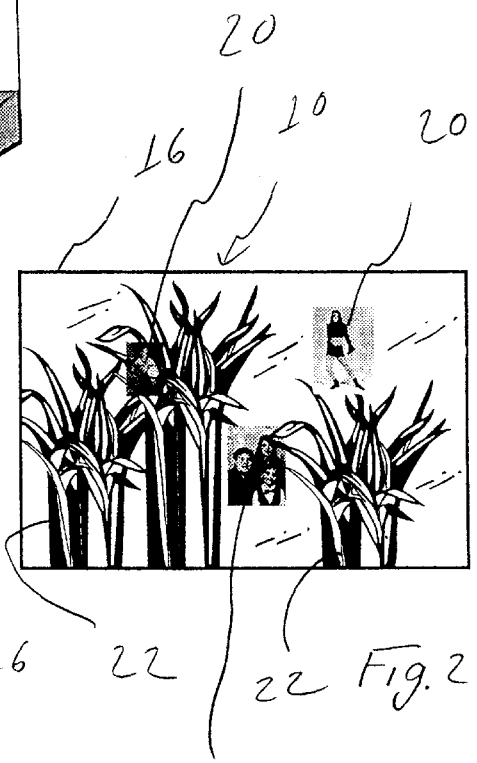
FIG. 2 is a perspective view of the aquarium photo display device of FIG. 1 in isolation secured to a back wall of the aquarium tank with photographs removably inserted into the two photo retaining pockets provided on the static cling attachable sea-life decorated plastic background sheet.
Figure 3:
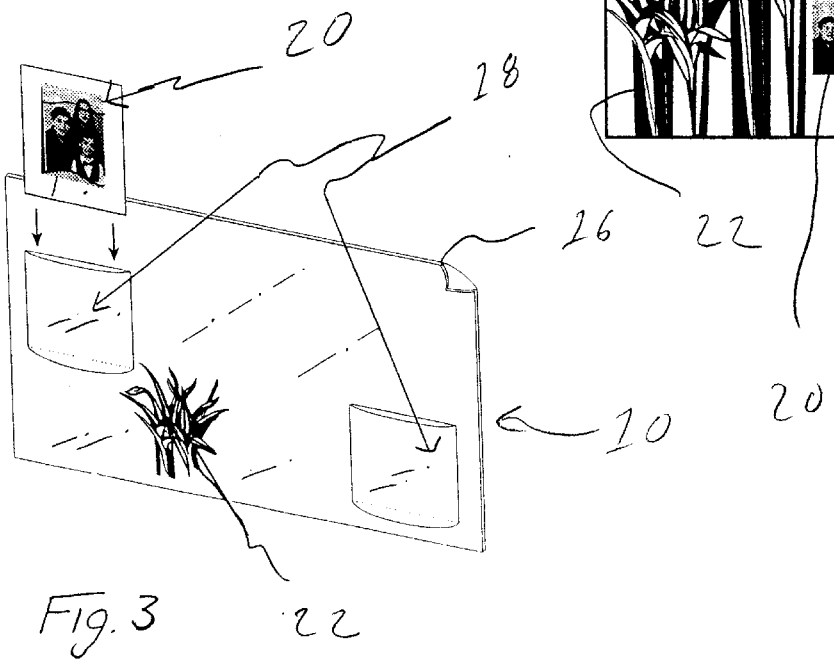
FIG. 3 is perspective view of a second exemplary embodiment of the aquarium photo display device of the present invention showing two photo retaining pockets provided on a static cling attachable sea-life decorated plastic background sheet.

FIG. 1–3 shows various aspects of an exemplary embodiment of the aquarium photo display device of the present invention, generally designated 10, and a representative aquarium tank, generally designated 12, having a back glass 14. Aquarium photo display device 10 includes a static cling attachable sea-life decorated plastic background sheet 16 having two transparent photo receiving pockets, generally designated 18, within which a photo 20 is removably insertable and various printed background elements 22.

An exemplary aquarium photo display method includes the steps of a) providing an aquarium photo display device 10 as described above; b) inserting a photo 20 into the transparent photo receiving pocket 18; and c) placing the static cling attachable sea-life decorated plastic background sheet 16 of the aquarium photo display device 10 against the back glass 14 of aquarium 12 with the photo 20 facing into and toward the front of aquarium 12.

It can be seen from the preceding description that an aquarium photo display device and method has been provided.

It is noted that the embodiment of the aquarium photo display device and method described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An aquarium photo displaying method for displaying a photo in connection with an aquarium having a back glass; the method comprising the steps of:

a) providing an aquarium photo display device including a static cling attachable sea-life decorated plastic background sheet having a transparent photo receiving pocket within which a photo is removably insertable;

b) inserting a photo into said transparent photo receiving pocket; and c) placing said static cling attachable sea-life decorated plastic background sheet against the back glass of an aquarium with the photo facing into the aquarium.

* * * * *